United States Patent [19]

Wanner

[11] 4,094,365

[45] June 13, 1978

[54] ELECTROHYDRAULICALLY OPERATED PORTABLE POWER TOOL

[75] Inventor: Karl Wanner, Echterdingen, Germany

[73] Assignee: Robert Bosch GmbH, Stuttgart, Germany

[21] Appl. No.: 712,247

[22] Filed: Aug. 6, 1976

Related U.S. Application Data

[63] Continuation of Ser. No. 574,715, May 5, 1975, Pat. No. 3,995,703.

[30] Foreign Application Priority Data

May 20, 1974 Germany ..... 2424391

[51] Int. Cl.[2] ..... B25D 11/00; B25D 9/00

[52] U.S. Cl. ..... 173/117; 173/105; 92/144

[58] Field of Search ..... 173/105, 117; 92/144; 60/51

[56] References Cited

U.S. PATENT DOCUMENTS

| | | | |
|---|---|---|---|
| 1,911,813 | 5/1933 | Decker | 173/117 |
| 1,920,673 | 8/1933 | Baker | 173/117 |
| 2,638,749 | 5/1953 | Sparano | 173/138 |
| 2,873,735 | 2/1959 | Deliot | 173/134 |
| 3,150,488 | 9/1964 | Haley | 60/51 |
| 3,695,366 | 10/1972 | Klessig | 173/134 |

*Primary Examiner*—James A. Leppink
*Attorney, Agent, or Firm*—Michael J. Striker

[57] ABSTRACT

A portable power tool wherein the housing contains a pump, a tank for a supply of oil for the pump, an electric motor for the pump and one or more hydraulic motors which receive pressurized oil from the pump and impart movements to a rotary and/or reciprocable tool, such as a rock drill or chisel. The motor which imparts reciprocatory movements to the tool is a cylinder and piston unit whose piston is rigid with a piston rod serving to strike against the tool whenever the piston performs a forward stroke. A valve assembly having a motor-driven rotary spool controls the flow of pressurized fluid to and the outflow of spent fluid from the cylinder. A spring brakes the rearward movements of the piston, and a bladder type accumulator is connected with the outlet of the pump. The tank is cooled by currents of air which are induced by a blower on the output shaft of the electric motor and which cool the electric motor before they reach cooling fins provided at the outer side of the tank.

2 Claims, 7 Drawing Figures

ELECTROHYDRAULICALLY OPERATED PORTABLE POWER TOOL

This is a continuation of application Ser. No. 574,715, filed May 5, 1975, U.S. Pat. No. 3,995,703.

BACKGROUND OF THE INVENTION

The present invention relates to portable power tools in general, especially to so-called impact type power tools wherein a reciprocable tool is struck by an impeller, and more particularly to improvements in portable power tools wherein the tool (such as a rock drill or chisel) receives motion from a fluid-operated motor. Still more particularly, the invention relates to improvements in portable power tools wherein a rotary and/or reciprocable tool receives motion from a hydraulic motor.

It is already known to provide a portable impact hammer with an impeller which is reciprocable by pressurized hydraulic fluid so that it performs alternating forward and return strokes and strikes against a tool during each of its forward strokes. The fluid is pressurized in a discrete aggregate having a pump which is driven by an electric motor or by a combustion engine and whose outlet is connected with the power tool by a flexible conduit. Another flexible conduit connects the housing of the power tool with a reservoir for hydraulic fluid.

A drawback of the just described power tools is that they are costly, complex, bulky and require frequent maintenance. Also, their efficiency is relatively low, especially due to leakage of hydraulic fluid which must be conveyed through several elongated flexible conduits, and also due to elasticity of such conduits. Moreover, the power tools as well as the aforementioned aggregates are noisy and the maximum distance between the power tool proper and the aggregate which supplies pressurized hydraulic fluid is relatively short. Still further, the versatility of conventional hydraulically operated portable power tools is rather limited.

SUMMARY OF THE INVENTION

An object of the invention is to provide a novel and improved hydraulically operated power tool which constitutes a self-contained unit and whose efficiency greatly exceeds the efficiency of conventional hydraulically operated power tools.

Another object of the invention is to provide an improved electrohydraulically operated power tool which can accept and impart one or more types of movements to a wide variety of tools, such as hammers, drills, chisels and/or others.

A further object of the invention is to provide a hydraulically or electrohydraulically operated portable power tool which generates less noise than heretofore known power tools and which is safer, more reliable and handier than conventional power tools.

An additional object of the invention is to provide a portable power tool which is especially suited for imparting rotary and/or reciprocatory movements to hammers, drills, chisels or analogous tools.

Still another object of the invention is to provide a novel and improved valve assembly for use in the above outlined hydraulically operated portable power tool, and to provide the power tool with novel and improved means for cooling the hydraulic fluid when the power tool is in use.

A further object of the invention is to provide a portable power tool wherein the type of movements which are imparted to a drill, chisel or the like can be changed while the power tool is in actual use.

The invention is embodied in a portable power tool, particularly in an impact type power tool, which comprises a hollow housing having one or more handles, holder means carried by the housing and serving to receive a tool which can perform movements with respect to the holder means (such movements may include reciprocatory and/or rotary movements), a hydraulic pump and a prime mover therefor mounted in the housing (the prime mover is preferably an electric motor and the pump may be a rotary or a reciprocatory pump), a receptacle provided in the housing and serving to contain a supply of oil or another suitable hydraulic fluid for the pump, and one or more hydraulic motors mounted in the housing, driven by pressurized fluid which is supplied by the pump (preferably but not necessarily through the medium of one or more valve assemblies) and serving to impart movements to a tool in the holder means.

The novel features which are considered as characteristic of the invention are set forth in particular in the appended claims. The improved power tool itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
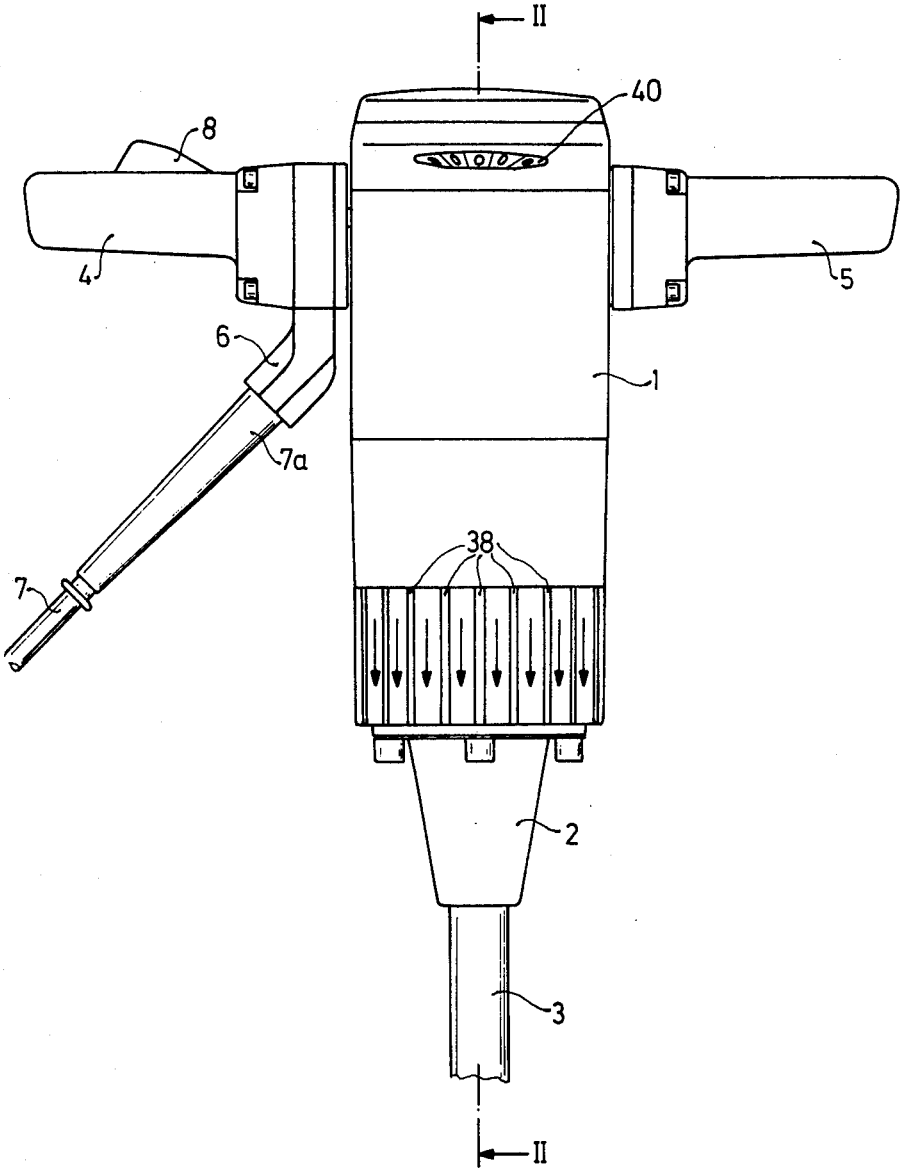
FIG. 1 is a side elevational view of a portable power tool which embodies one form of the invention, a portion of the tool being broken away.
Figure 2:
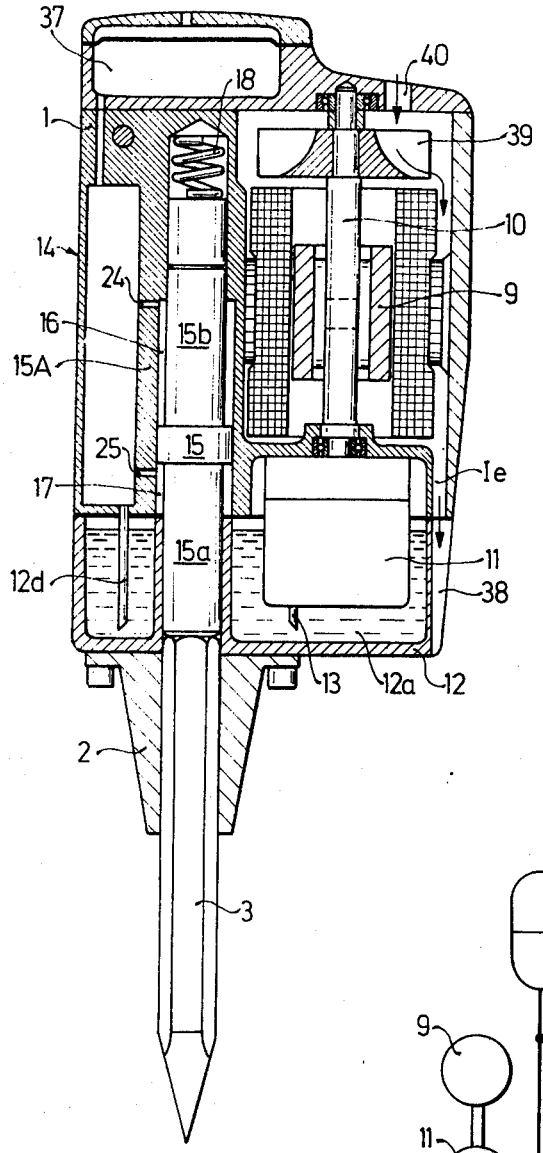
FIG. 2 is a sectional view as seen in the direction of arrows from the line II—II of FIG. 1.

Referring first to FIGS. 1 and 2, there is shown a portable electrohydraulically operated power tool having an elongated housing 1 of oval cross-sectional outline. One end portion of the housing 1 supports a holder 2 for a rotary and/or reciprocable tool 3, e.g., a chisel or drill for rock, stone or concrete. The other end portion of the housing 1 carries two handles 4, 5 which are disposed substantially diametrically opposite each other and are shown as being substantially normal to the axis of the tool 3. The handle 4 is adjacent to a socket 6 which can receive the prongs of a plug 7*a* at one end of a cable serving to connect an electric motor 9 in the housing 1 with a suitable source of electrical energy. An on-and-off trigger switch 8 for the motor 9 is mounted on or close to one of the handles 4, 5; FIG. 1 shows the switch 8 on the handle 4.

The electric motor 9 is mounted in that portion of the housing 1 which is nearer to the person who grips the handles 4, 5 while the power tool is in actual use. The output shaft 10 of this motor is parallel to the axis of the tool 3, and its lower end portion (as viewed in FIG. 2) drives the rotary parts of a hydraulic pump 11 mounted in the housing 1 in line with the motor 9. The pump 11 is at least partially immersed in a supply of hydraulic fluid 12*a* in a receptacle or tank 12 forming part of or being separably secured to the housing 1. The pump 11 is asumed to be a gear pump even though it is equally possible to employ a rotary piston pump, a vane type pump, a reciprocating pump or any other pump which can pressurize hydraulic fluid in response to rotation of the output shaft 10. The inlet 13 of the pump 11 is immersed in the body of hydraulic fluid 12 irrespective of the orientation or inclination of the housing 1, or at least in such positions of the housing which are normal or customary when the power tool is in actual use. In the embodiment of FIGS. 1 and 2, the inlet 13 is parallel with the tool 3 and its open end faces toward the material which is to be removed, drilled or otherwise treated by the tip of the tool 3.

Figure 3:
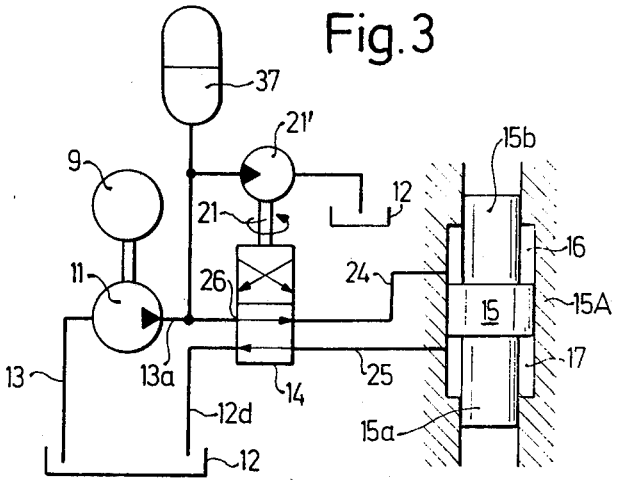
FIG. 3 is a diagrammatic view of the hydraulic circuit in the power tool of FIGS. 1–2.
Figure 4:
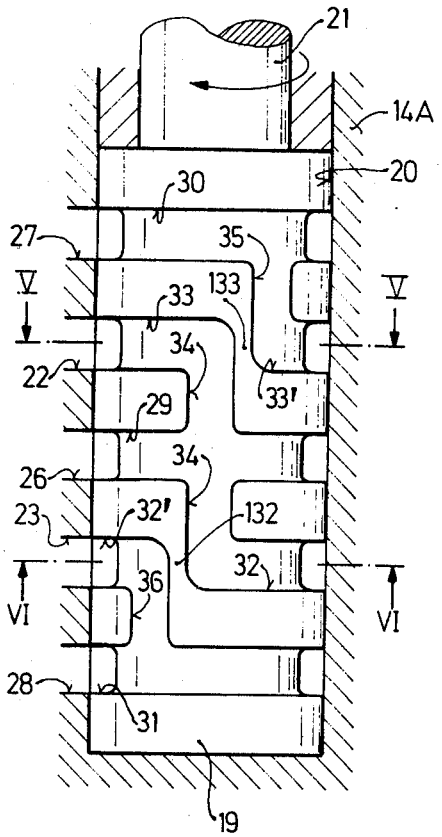
FIG. 4 is an enlarged axial sectional view of the valve assembly in the power tool of FIGS. 1–2.
Figure 5:
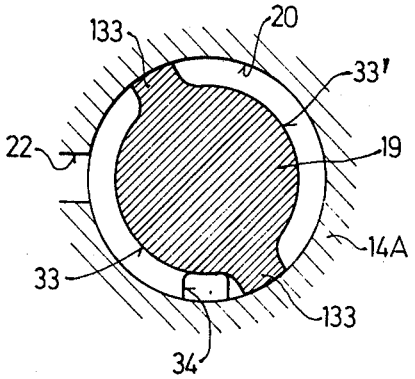
FIG. 5 is a sectional view as seen in the direction of arrows from the line V—V of FIG. 4.

The outlet 13*a* (see FIG. 3) of the pump 11 is connected with a valve assembly 14 which is installed in the housing 1 laterally of the motor 9 and the details of which are shown in FIG. 4. The valve assembly 14 controls the flow of pressurized fluid to and the flow of spent fluid from a hydraulic motor here shown as a double-acting cylinder and piston unit having a cylinder 15A with chambers 16, 17 disposed at the opposite sides of a piston 15 which is aligned with the tool 3. The piston rod for the piston 15 constitutes the output element of the hydraulic motor and has a front portion 15*a* which can strike against the rear end face of the tool 3 when the piston 15 is caused to move forwardly (downwardly, as viewed in FIG. 2) and a rear portion 15*b* which can stress a resilient element here shown as a helical spring 18 constituting a braking and cushioning device for the piston 15. The piston rod portion 15*a* transmits to the tool 3 mechanical impulses at intervals determined by the valve assembly 14 so that the tip of the tool 3 is driven into rock, stone, concrete or the like. The tool 3 receives an impulse when the valve assembly 14 admits pressurized fluid into the rear chamber 16, and the piston 15 is retracted so that the piston rod portion 15*b* stresses the spring 18 when the valve assembly 14 admits pressurized fluid into the front chamber 17 of the cylinder 15A.

Figure 6:
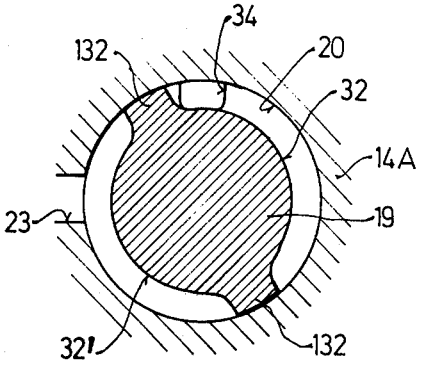
FIG. 6 is a sectional view as seen in the direction of arrows from the line VI—VI of FIG. 4.

The manner in which the valve assembly 14 alternately admits pressurized fluid into the chambers 16, 17 of the cylinder 15A will now be described with reference to FIGS. 3 to 6. This valve assembly has a body 14A which preferably constitutes a portion of the housing 1 and has a cylindrical bore 20 for a rotary valve member or spool 19. The latter is driven by the output shaft 21 of a hydraulic motor 21' (FIG. 3), preferably (but not necessarily) a gear type motor, which receives pressurized fluid from the pump 11. The body 14A has two ports 22, 23 which are spaced apart, as considered in the axial direction of the valve member 19, and which respectively communicate with the cylinder chambers 16, 17 via short channels or passages 24, 25 shown in FIGS. 2 and 3. A third port 26 of the body 14A is located between the ports 22, 23 and communicates with the outlet 13*a* of the pump 11. The ports 22, 23 are respectively adjacent to and are disposed between two additional ports 27, 28 which are connected with the tank 12 by a pipe 12*d* shown in FIG. 2. The peripheral surface of the valve member 19 is formed with three annular grooves or channels 29, 30, 31 which respectively communicate with the ports 26, 27 and 28 of the valve body 14A. Thus, the groove 29 communicates with the outlet 13*a* of the pump 11, and the grooves 30, 31 communicate with the tank 12 via pipe 12*d*. The peripheral surface of the valve member 19 is further formed with two composite circumferentially extending grooves or channels which are in line with the ports 22, 23 and each of which has two sections (shown at 33, 33' and 32, 32') extending along arcs of approximately 170° but not more than 180°. The sections 33, 33' are separated from each other by two axially parallel webs or lands 133 (FIG. 5), and the sections 32, 32' are separated from each other by two narrow lands 132 (FIG. 6). Still further, the peripheral surface of the valve member 19 has longitudinally extending channels or grooves 34, 35 and 36. The channels 34 connect the groove sections 32, 33 with the groove 29. The channels 35, 36 respectively connect the groove sections 32', 33' with the grooves 30, 31.

Referring again to FIG. 2, that end portion of the housing which is remote from the tool holder 2 contains a suitable accumulator 37, e.g., a bladder type accumulator which is connected in the hydraulic circuit between the outlet 13*a* and the port 26. This accumulator insures that the electric motor 9 and the pump 11 can operate with a high degree of efficiency even if (as is customary) the energy requirements of the power tool fluctuate within a wide range.

The hydraulic fluid 12*a* is cooled whenever the motor 9 is on. To this end, the exterior of the tank 12 has cooling ribs or fins 38 (see FIG. 1) so that it constitutes a heat exchanger serving to dissipate heat which is transmitted by heated fluid returning into its interior via pipe 12*d*. The ribs or fins 38 are forcibly cooled by currents of air which are produced by a rotary blower or fan 39 secured to the output shaft 10 of the motor 9 and inducing cool atmospheric air to flow in the directions indicated by arrows. Such air cools the motor 9 and thereupon issues via orifices 1*e* of the housing 1 to flow along the ribs 38. The upper end portion of the housing 1, as viewed in FIG. 1 or 2, has one or more air-admitting openings 40 adjacent to the suction side of the blower 39.

The operation is as follows:

The user grasps the handles 4, 5 and starts the electric motor 9 by actuating the switch 8. The output shaft 10 of the motor 9 drives the pump 11 and the blower 39. The pump 11 supplies pressurized fluid to the hydraulic motor 21' which rotates the valve member 19 via shaft 21. The pump 11 is preferably of sturdy construction so that it can stand long periods of use with a minimum of or without any maintenance. The rotating valve member 19 of the valve assembly 14 causes pressurized fluid to flow alternately into the cylinder chambers 16, 17 and the spent fluid to flow from the chambers 17, 16 back to the tank 12. Thus, the piston 15 reciprocates and causes the piston rod portion 15*a* to repeatedly strike against the rear end face of the tool 3. The rearward or upward movement of the piston 15 (in response to admission of pressurized fluid into the chamber 17) is braked by the spring 18. The piston 15 undergoes a uniform or substantially uniform acceleration during approximately 30–40 percent of each interval when the piston rod portion 15*a* performs a forward stroke. The piston rod portion 15*a* moves away and is thus spaced apart from the rear end face of the tool 3 during each rearward stroke of the piston 15 so that the tool 3 receives pronounced impacts whenever the direction of movement of the piston 15 is reversed in response to admission of pressurized fluid into the chamber 16. The spring 18 not only brakes the rearward movement of the piston rod portion 15*b* but also serves as a means for effecting initial acceleration of the piston 15 in a direction toward the tool 3 as a result of dissipation of energy which is stored while the spring 18 is being stressed by the piston rod portion 15*b*.

If the user of the power tool withdraws the tip of the tool 3 from the material which is being treated (e.g., a block of concrete or a piece of rock), the piston 15 is allowed to move all the way to its front end position so that the chamber 16 of the cylinder 15A communicates with the port 25. Thus, pressurized fluid can circulate through the chamber 16 by entering via channel 24 and leaving via channel 25 or vice versa whereby the motor 9 and pump 11 are idling. The pressurized fluid flows from the outlet 13*a* of the pump 11, through the valve assembly 14 and chamber 16 and back into the tank 12 via pipe 12*d*.

It has been found that the efficiency of the improved power tool greatly exceeds the efficiency of conventional power tools wherein the hydraulic system is not built directly into the housing. This is attributed to the fact that the kinetic energy of the piston 15 and piston rod 15*a*, 15*b* is transmitted in full to the material being treated through the medium of the tool 3. The latter is in continuous contact with the material being treated, and the impacts which it receives from the piston rod portion 15*a* are not unlike setting blows. This also reduces the generation of sound; in fact, the power tool produces a surprisingly small amount of noise.

An important feature of the improved power tool is that it embodies all advantages of electrically and all advantages of hydraulically operated portable power tools. This is due to the fact that the housing 1 of the power tool contains a complete motor-pump aggregate, i.e., that the pump need not be connected with the housing by one or more flexible conduits. The hydraulic motor including the cylinder and piston unit 15A, 15 imparts to the tool 3 a gradual and hence highly satisfactory axial acceleration when the output element 15*a*, 15*b* of this cylinder and piston unit moves forwardly to strike against the tool. This reduces the amplitude of vibrations which are being imparted to the housing 1 while the power tool is in use. Such low-amplitude vibrations are desirable not only for convenience of the operator but also because the power tool generates less noise. The length of paths along which the pressurized fluid flows on its way to the cylinder and piston unit is extremely short, especially when compared with the length of paths for such fluid in conventional hydraulically operated power tools wherein the motor-pump aggregate constitutes a discrete unit which is connected with the power tool by flexible conduits. This reduces the likelihood of losses of pressurized fluid and thus enhances the efficiency of the power tool.

Figure 7:
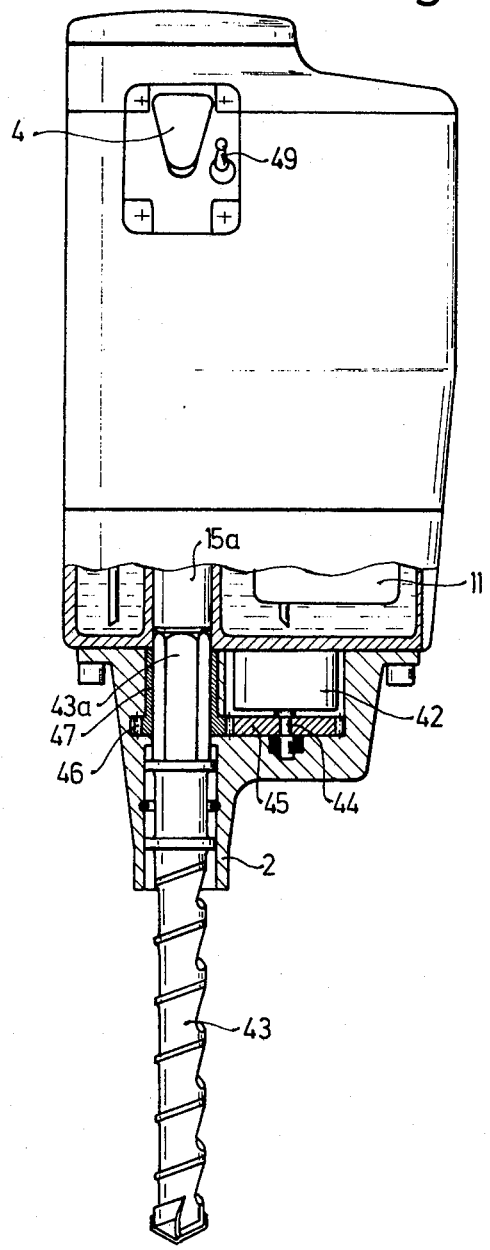
FIG. 7 is a partly elevational and partly sectional view of a modified power tool.

FIG. 7 shows a second embodiment of the power tool. The tool 43 is a drill which rotates when in use. The means for rotating the tool 43 of FIG. 7 comprises a hydraulic motor 42 which receives pressurized hydraulic fluid from the pump 11 and whose output shaft 44 drives a gear 45 in mesh with a gear 46 on a sleeve 47 which surounds the shank 43*a* of the tool 43. The shank 43*a* is reciprocable (by the piston rod portion 15*a*) in but cannot rotate relative to the sleeve 47. The motor 42 may be a gear type motor; such motors are preferred at this time because they are sufficiently sturdy to stand long periods of use without any or with minimal maintenance. The reference character 49 denotes a shutoff valve which can be actuated by the person grasping the handle 4 to disconnect the inlet of the motor 42 from the outlet of the pump 11, for example, when the tool 43 is replaced with a tool (such as the tool 3 of FIGS. 1–2) which need not rotate when the power tool is in use. The valve 49 enhances the versatility of the power tool in that it enables the user to employ a reciprocable tool or to employ a rotary and reciprocable tool and to terminate the rotation of a rotary and reciprocable tool when the reciprocatory movement suffices or is preferred over a combined rotary and reciprocatory movement.

The improved power tool is susceptible of many additional modifications. For example, the gear pump 11 can be replaced with a rotary piston pump, a vane pump, a reciprocating pump or any other type of pump which can be driven by the motor 9 or an analogous prime mover. Moreover, the valve member 19 of the valve assembly 14 can be rotated and/or otherwise moved by a discrete electric motor which then replaces the hydraulic motor 21' of FIG. 3, or by a transmission which receives motion from the motor 9. Still further, the hydraulic motor 42 of FIG. 7 can be replaced by an electric motor or by a transmission which receives motion from the motor 9.

The valve assembly 14 can be replaced with a valve assembly having a reciprocable valve member, e.g., a valve member which receives motion from the piston 15 of the hydraulic motor for imparting reciprocatory movements to the tool 3 or 43. If desired, the housing of the power tool may carry an additional valve which can deactivate the hydraulic motor or motors of the power tool when the tip of the tool is disengaged from the material being treated and which can activate such hydraulic motor or motors when the tip of the tool reengages the material. The additional valve may be actuated by hand or automatically. In such power tools, the motor 9 is started independently of the hydraulic motor or motors and idles with the pump 11 until and unless the tip of the tool engages a piece of rock or the like. Finally, it is evident that the tools 3 and 43 represent but two examples of many tools which can be used in the improved power tool.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. A portable power tool, particularly an impact type power tool, comprising a hollow housing;

holder means carried by said housing and arranged to receive a tool adapted to reciprocate with respect thereto;

a hydraulic pump mounted in said housing;

a receptacle provided in said housing and arranged to contain a supply of hydraulic fluid for said pump;

hydraulic motor means mounted in said housing, driven by pressurized fluid supplied by said pump and including a double-acting cylinder which has a first and a second chamber and in which said tool is received so as to reciprocate therein;

a valve assembly mounted in said housing, connected with said pump and operative to alternately admit pressurized fluid into said first and second chambers and to thereby effect reciprocation of said tool;

means for cooling the supply of hydraulic fluid in said receptacle including blower means mounted in said housing; and an electric motor mounted in said housing and arranged to drive said hydraulic pump and said blower means, said blower means being arranged for sucking air into said housing and then inducing the flow of sucked air from said blower means first along said electric motor and thereupon along the exterior of said receptacle.

2. A power tool as defined in claim 1, wherein said cooling means comprises external fins provided in said receptacle.

* * * * *